US006626747B1

(12) United States Patent
Sidebottom

(10) Patent No.: US 6,626,747 B1
(45) Date of Patent: Sep. 30, 2003

(54) ABRASIVE PAD

(75) Inventor: John T. Sidebottom, Lockport, NY (US)

(73) Assignee: Duraline Abrasives, Inc., Lockport, NY (US)

( * ) Notice: Subject to any disclaimer, the term of this patent is extended or adjusted under 35 U.S.C. 154(b) by 0 days.

(21) Appl. No.: 09/630,833

(22) Filed: Aug. 2, 2000

(51) Int. Cl.[7] ..... B24B 9/10

(52) U.S. Cl. ..... 451/502; 451/510; 451/521; 451/523

(58) Field of Search ..... 451/502, 508, 451/510, 521, 523

(56) References Cited

U.S. PATENT DOCUMENTS

| | | | | | |
|---|---|---|---|---|---|
| 1,921,211 | A | * | 8/1933 | Bawden | 451/523 |
| 2,036,107 | A | * | 3/1936 | Thomas | 451/523 |
| 2,038,782 | A | * | 4/1936 | Ellis | 451/539 |
| 2,550,393 | A | * | 4/1951 | Wurfschmit | 451/524 |
| 2,626,489 | A | * | 1/1953 | Thompson | 451/523 |
| 2,626,490 | A | * | 1/1953 | Meers | 451/510 |
| 2,700,852 | A | * | 2/1955 | Field | 451/524 |
| 2,864,208 | A | * | 12/1958 | Ringer | 451/524 |
| 3,046,709 | A | * | 7/1962 | Cook | 451/510 |
| 5,720,654 | A | * | 2/1998 | Mac Donald | 451/524 |

* cited by examiner

*Primary Examiner*—M. Rachuba
(74) *Attorney, Agent, or Firm*—Phillips, Lytle, Hitchcock, Blaine & Huber LLP

(57) ABSTRACT

The invention is directed to an improved abrasive pad (15). In the preferred embodiment, the abrasive pad is comprised of an inner core (16) having an outer surface (19), a strip of abrasive material (18), the strip of abrasive material wrapped around the outer surface of the inner core, and a central throughbore (20) extending through the material and the inner core and adapted for engagement with a torque-producing device. The outer surface of the abrasive pad may comprise a top surface (21), a bottom surface (22), a front surface (23), a rear surface (24), a right surface (25), and a left surface (26), and the abrasive strip may be wrapped over the right surface, the bottom surface, the left surface, and the top surface to form a first layer (28) of abrasive material. The abrasive strip may be wrapped around the inner core at least twice to form at least a second layer (29) of abrasive material. The abrasive material may be sandpaper and the throughbore may be threaded (35) for engagement with a mandrel. The throughbore may further comprise a grommet (36) holding the strip of material around the inner core. The inner core may be generally rectangular and further comprise at least one chamfer surface (38).

11 Claims, 2 Drawing Sheets

ABRASIVE PAD

TECHNICAL FIELD

The present invention relates generally to the field of sanding devices and, more particularly, to an improved abrasive pad for polishing or sanding the inside of hollow objects.

BACKGROUND ART

A variety of mechanisms have been used in the past to sand the inside of hollow objects. Generally, these devices have consisted of a square pad made up solely of two strips of an abrasive sanding material which are folded at right angles over each other. The pad is designed to be attached to a mandrel, which spins the pad such that its four corners may be used to polish the inside of an object, such as a hollow cylinder.

However, these devices have a number of drawbacks. First, their formation is such that a good deal of the abrasive material is not used and is, therefore, wasted. Second, they are not designed to dissipate heat caused by frictional contact when in operation. Third, they do not lend themselves to efficient and cost-effective manufacturing. Fourth, they are limited in the type of abrasive materials with which they may be used. Fifth, they often vibrate when in use because of imprecise centering of the mandrel with the pad.

Hence, it would be useful to provide an abrasive pad which is more cost effective to manufacture, can be made with a wide variety of abrasive materials, and results in improved operations.

DISCLOSURE OF THE INVENTION

With parenthetical reference to the corresponding parts, portions or surfaces of the disclosed embodiment, merely for purposes of illustration and not by way of limitation, the present invention provides an improved abrasive pad (15) comprising an inner core (16) having an outer surface (19), a strip of abrasive material (18), the strip of abrasive material wrapped around the outer surface of the inner core, and a central throughbore (20) extending through the material and the inner core and adapted for engagement with a torque-producing device. The outer surface of the abrasive pad may comprise a top surface (21), a bottom surface (22), a front surface (23), a rear surface (24), a right surface (25), and a left surface (26), and the abrasive strip may be wrapped over the right surface, the bottom surface, the left surface, and the top surface to form a first layer (28) of abrasive material. The abrasive strip may be wrapped around the inner core at least twice to form at least a second layer (29) of abrasive material. The abrasive material may be sandpaper.

The throughbore may be threaded (35) for engagement with a mandrel. The throughbore may further comprise a grommet (36) holding the strip of material around the inner core. The inner core may be generally rectangular and further comprise at least one chamfer surface (38).

Accordingly, the general object of the present invention is to provide an improved abrasive pad which may be used to polish or sand the inside of hollow objects.

Another object is to provide an improved abrasive pad which increases airflow so as to decrease heat associated with its use.

Another object is to provide an improved abrasive pad which employs an inner core around which an abrasive strip is tightly wound.

Another object is to provide an improved abrasive pad with a core which assists in automating the manufacturing of the pad.

Another object is to provide an improved abrasive pad in which the abrasive material is tightly wrapped.

Another object is to provide an improved abrasive pad which may be manufactured so as to conserve abrasive materials.

Another object is to provide an improved abrasive pad which may be composed of a number of types of abrasive materials.

Another object is to provide an improved abrasive pad which allows for the use of more expansive and better abrasive wraps.

Another object is to provide an improved abrasive pad which allows for more precise centering of the eyelet or throughbore.

Another object is to provide an improved abrasive pad which reduces vibrations when in use.

Another object is to provide an improved abrasive pad which dissipates heat when in use.

These and other objects and advances will become apparent from the foregoing and ongoing written specification, the drawings, and the appended claims.

DESCRIPTION OF THE PREFERRED EMBODIMENTS

Figure 1:
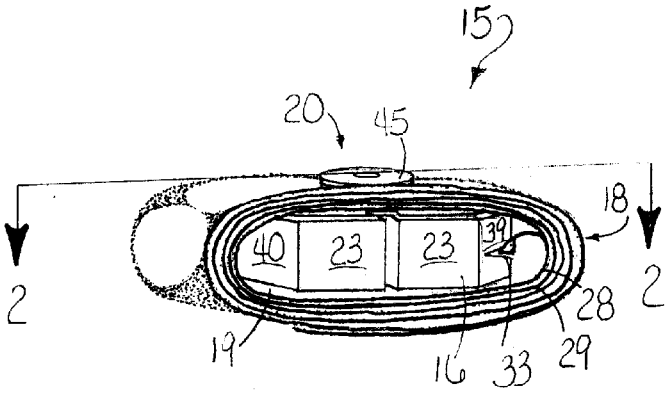
FIG. 1 is a perspective view of the abrasive pad.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Referring now to the drawings, and more particularly, to FIG. 1 thereof, this invention provides an improved abrasive pad, of which the presently preferred embodiment is generally indicated at 15. Abrasive pad 15 is shown as broadly including an inner core 16, a strip of abrasive material 18, and a central throughbore 20 which extends through the material and the core and is adapted for engagement with a torque-producing device.

Figure 3:
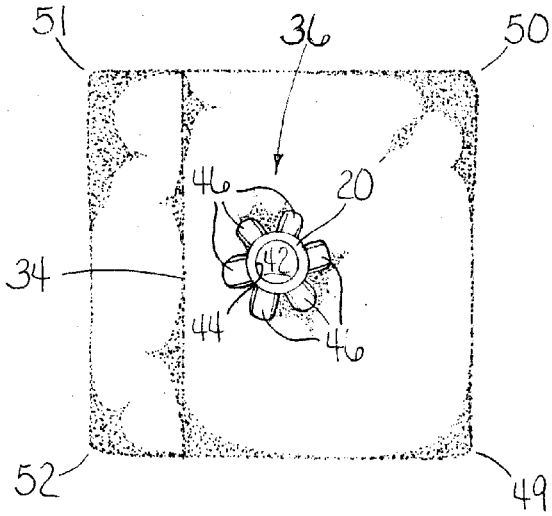
FIG. 3 is a bottom elevation of the abrasive pad shown in FIG. 1.
Figure 4:
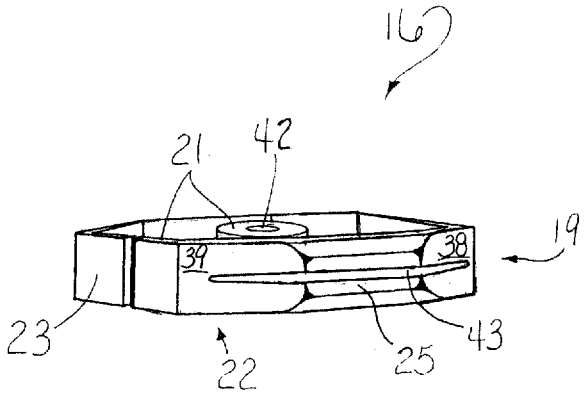
FIG. 4 is a perspective view of the inner core of the abrasive pad shown in FIG. 1.
Figure 5:
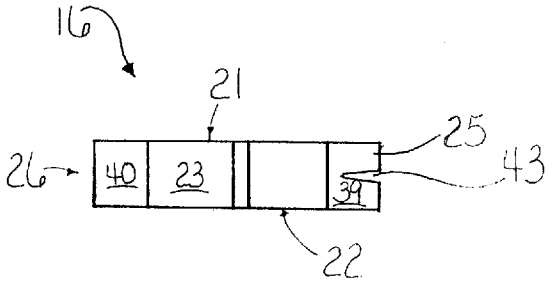
FIG. 5 is a left-side elevation of the inner core shown in FIG. 4.
Figure 6:
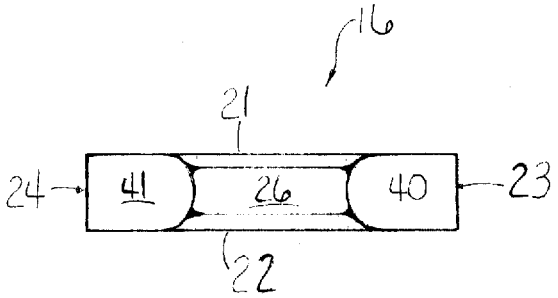
FIG. 6 is a rear elevation of the inner core shown in FIG. 4.
Figure 7:
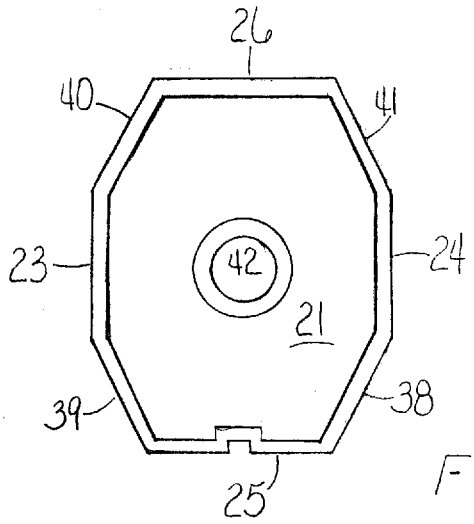
FIG. 7 is a top plan view of the inner core shown in FIG. 4.

As shown in FIGS. 4–7, inner core 16 broadly includes an outer surface 19 and a inner core throughbore 42. Outer surface 19 generally comprises a top surface 21, a bottom surface 22, a front surface 23, a rear surface 24, a right surface 25, and a left surface 26. As shown in FIG. 7, outer surface 19 of inner core 16 also comprises a first chamfer surface 38, a second chamfer surface 39, a third chamfer surface 40, and a fourth chamfer surface 41. Therefore, rather than inner core 16 resembling a square member with right angle intersections between front surface 23 and right surface 25, front surface 23 and left surface 26, rear surface 24 and right surface 25, and rear surface 24 and left surface 26, such right angle intersections have been replaced with chamfer surfaces 38 through 42, respectively. Thus inner core 16 appears as an octagonal-shaped member. Accordingly, as shown in FIGS. 1 and 3, chamfer cut surfaces 38–42 result in greater flexibility at the four comers 49–52 of abrasive material 18 when it is wound around inner core 16.

Figure 2:
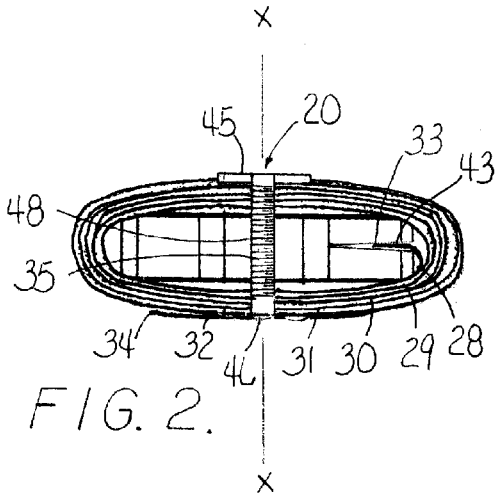
FIG. 2 is a transverse vertical sectional view of the abrasive pad shown in FIG. 1, taken generally on line 2—2 of FIG. 1.

As shown in FIG. 2, abrasive pad 15 is generally formed by wrapping abrasive material 18 around inner core 16. Abrasive material 18 is a rectangular strip of material, on one side of which is an abrasive surface and on the other side of which is a smooth surface. The abrasive side is wrapped to face away from inner core 16. In the preferred embodiment, abrasive strip 18 has a width equal to the transverse distance between front surface 23 and rear surface 24, and is long enough to wrap around inner core 16 five times.

As shown in FIGS. 5–6, inner core 16 includes a V-shaped kerf 43 cut into right surface 24 of inner core 16. As shown in FIG. 2, the inner edge 33 of abrasive material 18 is positioned in kerf 43.

To form the pad, inner edge 33 of abrasive material 18 is inserted into kerf 43 near its narrowest point. As shown in FIG. 1, abrasive material 18 is folded around the intersection of right surface 25 and bottom surface 22, wrapped across bottom surface 22, folded around the intersection of bottom surface 22 and left surface 26, wrapped across left surface 26, folded around the intersection of left surface 26 and top surface 21, wrapped across top surface 21, folded around the intersection of top surface 21 and right surface 25, wrapped over right surface 25 and the opening of kerf 43 such that it overlaps, thus forming a first layer 28 of abrasive material 18 around inner core 16. As shown in FIG. 2, this procedure is duplicated to form second layer 29, third layer 30, fourth layer 31, and fifth layer 32. Abrasive material 18 has a length such that after forming fifth layer 32, strip 18 is wrapped across bottom surface 22 such that outer edge 34 of strip 18 extends beyond throughbore 20.

As shown in FIG. 3, throughbore 20 is a formed from a cylindrical metal structure having a cylindrical portion 48, an annular flange 45 at its top end and, as shown in FIG. 3, annular fingers, severally indicated at 46, at its bottom end. Cylindrical portion 48 is elongated about axis x-x and includes an inwardly-facing horizontal cylindrical surface 44. Cylindrical surface 44 generally defines axial throughhole 42. Portion 48, flange 45 and fingers 46 form a grommet 36, which holds abrasive strip 18 tightly wrapped around inner core 16.

Flange 45 is configured to rest against and hold abrasive material 18 against top surface 21 of inner core 16. Fingers 46 are folded transverse to cylindrical surface 44 and hold abrasive material 18, including outer edge 34, against bottom surface 22 of inner core 16. Thus, grommet 36 prevents abrasive material 18 from unwinding. Cylindrical portion 48 of throughbore 20 is threaded for engagement with the corresponding threads of the mandrel of a torque-producing device. Thus, pad 15 may be mounted on a torque-producing device. The device may then be used to spin abrasive pad 15 around axis x—x such that first comer 49, second comer 50, third comer 51, and fourth comer 52 may be used to polish the inside of an item, such as a hollow cylinder.

The present invention contemplates that many changes and modifications may be made. Therefore, while the presently-preferred form of the improved apparatus has been shown and described, and several modifications thereof discussed, persons skilled in this art will readily appreciate that various additional changes and modifications may be made without departing from the spirit of the invention, as defined and differentiated by the following claims.

What is claimed is:

1. An abrasive pad comprising:

a rigid core having at least two opposing planar outer surfaces;

a flexible strip of abrasive material having an abrasive outer surface;

said flexible strip of abrasive material wrapped around said opposing outer planar surfaces such that said opposing outer planar surfaces are substantially parallel to at least two opposing portions of said abrasive outer surface;

a central throughbore extending through said core and the exterior surfaces of said two opposed portions of said abrasive outer surface and adapted for engagement with a torque-producing device;

said central throughbore having an axis of elongation substantially perpendicular to at least a portion of said opposing planar outer surfaces.

2. The abrasive pad set forth in claim 1, wherein said opposing outer surfaces comprise a top surface and a bottom surface;

wherein said core further comprises a front surface, a rear surface, a right surface, and a left surface; and wherein said abrasive strip is wrapped over said right surface, said bottom surface, said left surface, and said top surface to form a first layer of abrasive material.

3. The abrasive pad set forth in claim 2, wherein said abrasive strip is wrapped around said core at least twice to form at least a second layer of abrasive material.

4. The abrasive pad set forth in claim 1, wherein said abrasive material is sandpaper.

5. The abrasive pad set forth in claim 1, wherein said throughbore is threaded for engagement with a mandrel.

6. The abrasive pad set forth in claim 1, wherein said throughbore further comprises a grommet which holds said strip around said core.

7. The abrasive pad set forth in claim 2, wherein said inner core further comprises at least one chamfer surface.

8. A method of using an abrasive pad comprising the steps of:

providing the abrasive pad set forth in claim 1;

providing a torque producing device;

engaging said torque-producing device with said central throughbore;

operating said torque-producing device so as to rotate said abrasive pad.

9. The abrasive pad set forth in claim 1, wherein said opposing outer surfaces comprise a top planar surface and a bottom planar surface and wherein said top planar surface has a first inner planar portion and a second outer planar portion non-contiguous to said first inner portion.

10. The abrasive pad set forth in claim 9, wherein said first inner planar portion is circular.

11. The abrasive pad set forth in claim 1, wherein said opposing planar surfaces are parallel surfaces.

* * * * *